US007740079B2

(12) United States Patent
Clayton et al.

(10) Patent No.: US 7,740,079 B2
(45) Date of Patent: Jun. 22, 2010

(54) FRACTURING PLUG CONVERTIBLE TO A BRIDGE PLUG

(75) Inventors: Robert Clayton, Calgary (CA); Jesse Porter, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 130 days.

(21) Appl. No.: 11/893,445

(22) Filed: Aug. 16, 2007

(65) Prior Publication Data

US 2009/0044957 A1 Feb. 19, 2009

(51) Int. Cl.
*E21B 33/12* (2006.01)
*E21B 33/129* (2006.01)

(52) U.S. Cl. ..... 166/387; 166/102; 166/135; 166/192; 166/193

(58) Field of Classification Search ..... 166/102, 166/135, 192, 193, 387
See application file for complete search history.

(56) References Cited

U.S. PATENT DOCUMENTS 4,532,989 A * 8/1985 Barker ..... 166/188
5,224,540 A 7/1993 Streich et al.
5,271,468 A 12/1993 Streich et al.
5,540,279 A 7/1996 Branch et al.
5,701,959 A 12/1997 Hushbeck et al.
5,839,515 A 11/1998 Yuan et al.
5,984,007 A 11/1999 Yuan et al.
6,167,963 B1 1/2001 McMahan et al.
6,394,180 B1 5/2002 Berscheidt et al.
6,491,116 B2 12/2002 Berscheidt et al.
6,695,057 B2 2/2004 Ingram et al.
6,708,770 B2 3/2004 Slup et al.
6,712,153 B2 3/2004 Turley et al.
7,048,066 B2 5/2006 Ringgenberg et al.
7,124,831 B2 10/2006 Turley et al.
7,350,582 B2 4/2008 McKeachnie et al.
2006/0278405 A1 * 12/2006 Turley et al. ..... 166/385
2007/0051521 A1 * 3/2007 Fike et al. ..... 166/387

* cited by examiner

*Primary Examiner*—Giovanna C Wright
(74) *Attorney, Agent, or Firm*—John W. Wustenberg; McAfee & Taft

(57) ABSTRACT

A tool that is easily convertible from a frac plug to a bridge plug is disclosed. The tool comprises a mandrel with a mule shoe connected to the lower end thereof. A closing ball is disposed in a cavity defined by the mule shoe. The mandrel is threaded to receive a plug at or near the upper end thereof to convert the frac plug to a bridge plug.

26 Claims, 2 Drawing Sheets

FRACTURING PLUG CONVERTIBLE TO A BRIDGE PLUG

BACKGROUND

In the drilling or reworking of oil wells a great variety of downhole tools are used. Many downhole tools for use in oil and gas wellbores have drillable components made from metallic or non-metallic materials. One common downhole tool is used to seal tubing or other pipe from the casing of the well such as when it is desired to pump a fluid slurry down the tubing and to force the fluid down into a formation. It is necessary in such cases to seal the tubing with respect to the well casing and to prevent the fluid pressure from lifting the tubing out of the well. Downhole tools referred to as packers and bridge plugs are designed for these general purposes and are well known in the art of producing oil and gas. Bridge plugs generally completely isolate the portion of the well below the bridge plug from the portion thereabove. Such bridge plugs may often be made of drillable components so that they can be drilled from the well after use.

A frac plug is another commonly used well tool. Frac plugs are typically set in a well to isolate the portion thereabove from the portion therebelow so that fluid can be forced into a formation above the frac plug. When frac plugs are set in the well, however, they will allow flow in one direction. Frac plugs therefore may generally be used when it is desired to produce fluid from zones above and below the frac plug. When fluid is pumped into a well above a frac plug so that pressure above the frac plug is greater than the pressure therebelow, the frac plug will prevent flow downwardly therethrough so that the fluid may be forced into a formation thereabove. Once such treatment is completed and pressure below the frac plug is greater than the pressure thereabove, fluid from below the frac plug may flow upwardly through the frac plug and along with fluid from any formations above the frac plug can be flowed to the surface. While both frac plugs and bridge plugs are known, there are no known tools that are easily convertible from frac plugs to bridge plugs.

SUMMARY

A tool for use in a wellbore is disclosed. The tool may comprise a mandrel with a sealing element disposed thereabout. The mandrel has upper and lower ends and may have a lower end section, such as a mule shoe, connected at the lower end thereof. A cage or cavity is defined by the mule shoe. The cavity may have upper or lower ends defined by the mandrel and by a seat defined in the mule shoe. A closing ball, which also may be referred to as a frac ball, is disposed in the cavity. The mandrel has an upper end adapted to receive a plug, for example, a threaded plug which may be threaded into the mandrel.

The tool may be lowered into a well and utilized as a frac plug by setting the tool in the well so the sealing elements engage the well. Fluid pumped into the well will cause the frac ball to seat in the mule shoe. Fluid will therefore be forced into a formation above the tool so that the formation can be treated. Once fluid pressure is released so that the pressure below the tool is greater than the pressure thereabove, fluid from below the tool will pass therethrough and that fluid, along with any fluid from the formation above the tool, may be produced in the well to the surface.

The tool may be easily converted to a bridge plug simply by threading a plug into the threads in the mandrel at or near the upper end thereof. The tool, after conversion to a bridge plug may be lowered into the well and set so that the sealing elements engage the well. Fluid can then jumped into the well and into a formation that intersects the well to treat the formation. Once fluid pressure is released, fluid from the formation above the bridge plug may flow upwardly in the well. The bridge plug will prevent any fluid in the well below the bridge plug from passing upwardly therethrough. Alternatively, the tool may be initially made up as a bridge plug, and then converted to a frac plug by removing the threaded plug from the mandrel.

The tool is preferably a drillable tool so that it may be removed by drilling if desired. Components of the tool therefore may be comprised of drillable materials such as for example, but not limited to phenolic or composites. The mule shoe, mandrel and threaded plug may be comprised of a phenolic material and more specifically a molded phenolic material which can be threaded so that the components can be easily and efficiently connected and disconnected simply by threading and unthreading.

DETAILED DESCRIPTION OF AN EMBODIMENT

Figure 1:
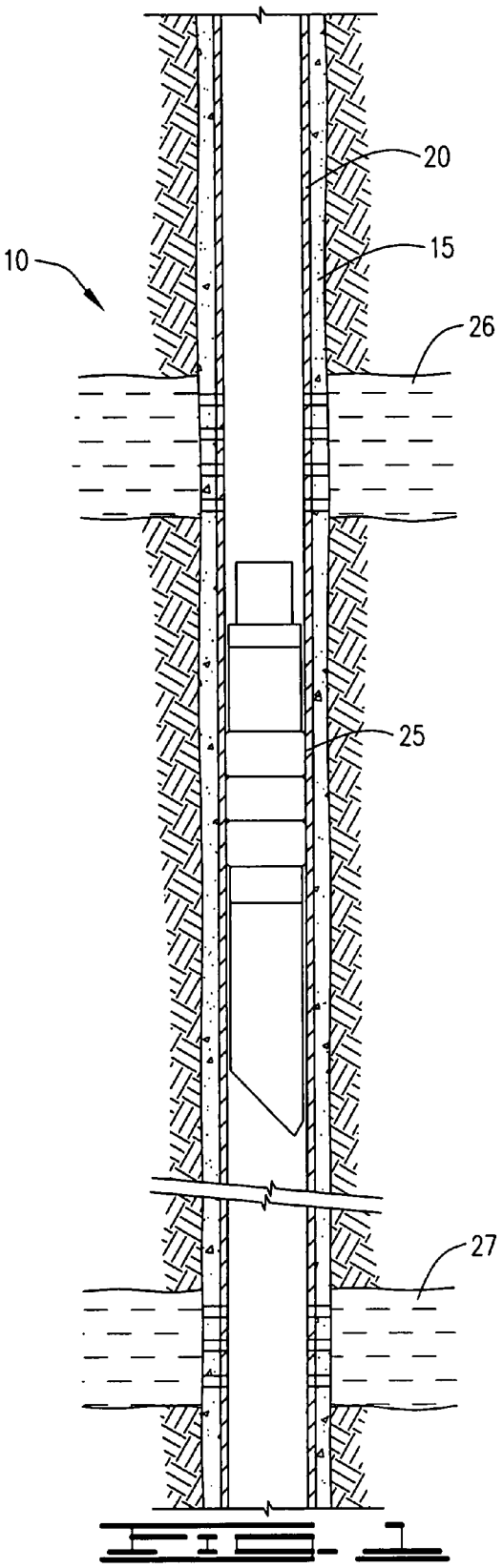
FIG. 1 schematically shows a downhole tool disposed in a well.

Referring to the drawings, FIG. 1 shows well 10 comprising a wellbore 15 with casing 20 cemented therein. Downhole tool 25 is shown in its set or expanded position in well 10. Well 10 may intersect one or more formations such as formations 26 and 27. Formations 26 and 27 may be communicated with casing 20 by perforating, or by other means known in the art. Downhole tool 25 may also be referred to as a frac plug that is convertible to a bridge plug as will be explained herein.

Figure 2:
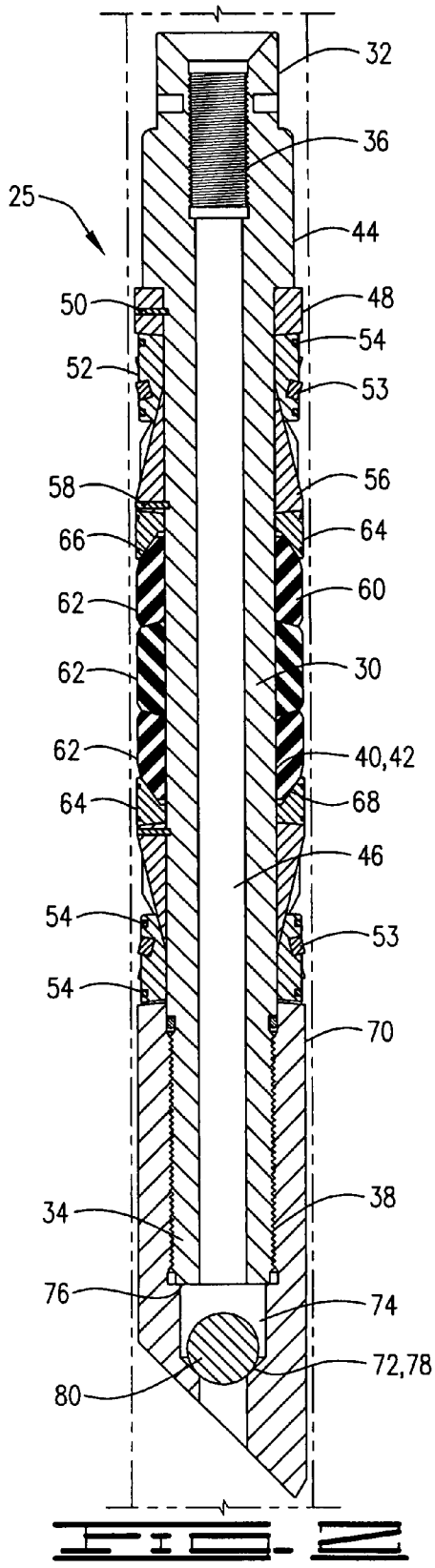
FIG. 2 is a cross-sectional view of the tool.
Figure 3:
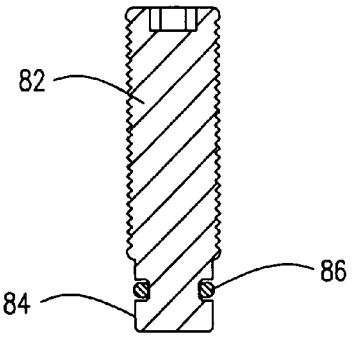
FIG. 3 is a cross-sectional view of a plug for converting the tool from a frac plug to a bridge plug.

Referring now to FIG. 2, downhole tool 25 is shown in its running or unset position. Downhole tool 25 comprises a mandrel 30 with first, or upper end 32 and second, or lower end 34. The mandrel may have internal threads 36 at, or near upper end 32 adapted to receive a threaded plug as will be described in detail hereinbelow. Mandrel 30 has external threads 38 on an outer surface thereof at or near the lower end 34. Mandrel 30 has outer diameter 40 along a central or working portion 42 thereof and includes a hub 44 extending radially outwardly from diameter 40. Mandrel 30 defines a longitudinal central flow passage 46 therethrough.

Figure 4:
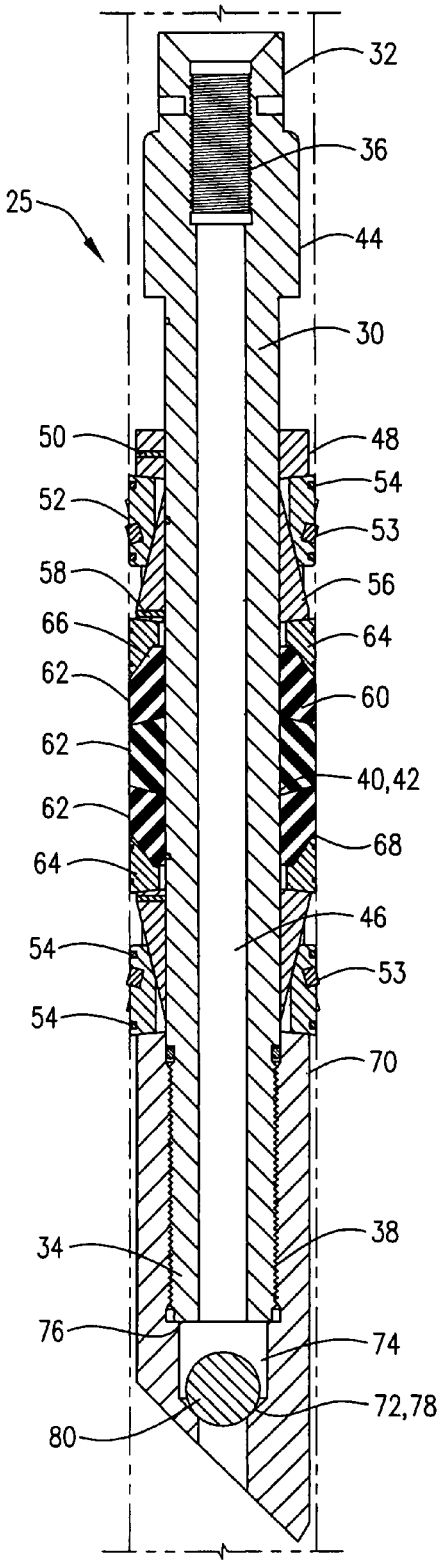
FIG. 4 is a cross-sectional view of the tool in its expanded position wherein it engages a well.

Packer tool 25 may include spacer ring 48 pinned with pins 50 to axially retain slip segments 52 which are circumferentially positioned about mandrel 30. A slip retaining band 54 may be utilized to radially retain slips 52 in the initial or unset position shown in FIG. 2. Slips 52 may include buttons 53 which serve to help hold the tool in position in the well in its set position which is shown in FIG. 4. Buttons may be for example like those disclosed in U.S. Pat. No. 5,984,007 assigned to the assignee hereof. Bands 54 may be made of steel wire, plastic material or composite material having the requisite characteristics having sufficient strength to hold the slips in place while running the tool in the well and prior to setting the tool. Band 54 may be drillable so that if it is desired to remove the tool from the wellbore, tool 25 may be drilled from the well.

Slip wedge 56 may be initially positioned in a slidable relationship to and partially beneath slip segments 52. Slip wedge 56 may be pinned in place with pin 58. A packer element assembly 60, which in the embodiment shown comprises three expandable sealing, or packer elements 62 is disposed about mandrel 30. Packer shoes 64 may be disposed about mandrel 30 at the upper and lower ends 66 and 68 of packer element assembly 60. The slips, slip wedges and packer shoes may be made of a drillable material and specifically of a non-metallic material such as plastics which may be molded or machined, and may also be made of composites.

Tool 25 has a lower, or second end section 70 which may be referred to as a shoe, or mule shoe 70. Lower end section 70 is threaded to mandrel 30 at threads 38. Shoe 70 defines a seat 72. A cavity or cage 74 has an upper end 76 defined by lower end 34 of mandrel 30, and a lower end 78 defined by seat 72. A flow restriction, such as closing ball 80, which may be referred to as frac ball 80, is retained in cavity 74 and specifically by lower end 34 of mandrel 30 and by seat 72. Closing ball 80 is movable between lower end 34 of mandrel 30 and seat 72 in shoe 70.

Tool 25 therefore has a mandrel 30 with one end adapted to be connected to a plug, and a second end adapted to be connected to an end section that will movably contain a frac ball. In the embodiment shown, first end 32 is adapted to receive threaded plug 82, and second end 34 is adapted to be connected to lower end section 70, which contains frac ball 80.

Mandrel 30 and lower end section 70 are preferably made from a molded phenolic such that they may be threaded together. While it is known to make a mandrel and/or mule shoe from a non-metallic material such as a composite, it is not known in the art to manufacture such components from drillable materials that can be threaded together to define a cavity or cage for a frac ball.

Tool 25 may be lowered into well 10 by means known in the art, such as for example with a wireline. When tool 25 is run in the well and set so that packer elements 62 engage casing 20 as is shown in FIG. 4, and the pressure is greater above the tool 25 than the pressure below, frac ball 80 will engage seat 72, and tool 25 will prevent downward flow through well 10. Thus, a formation above tool 25, such as formation 26 may be treated by pumping a treatment fluid into well 10. The treatment fluid will move into formation 26 and will be prevented from flowing downwardly in well 10 by tool 25. When pressure above tool 25 is released, fluids from below the tool 25, such as, for example fluid from formation 27, along with fluids from any formation thereabove may be flowed upwardly to the surface.

Figure 5:
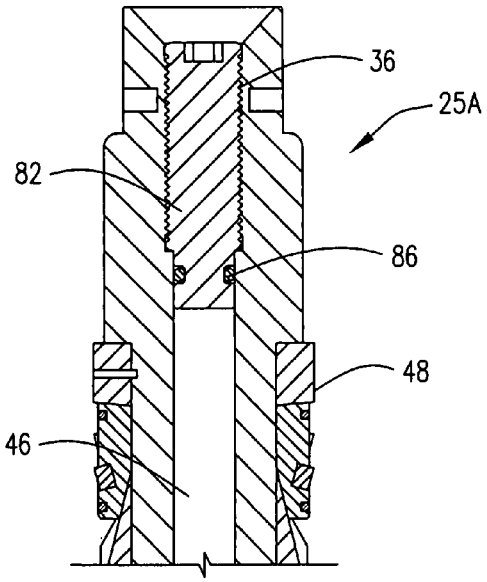
FIG. 5 is a cross-sectional view of the tool with the plug of FIG. 3 installed.

Tool 25 may be easily converted to a bridge plug with threaded plug 82 which may be made from a molded phenolic material. Threaded plug 82 may be threaded or connected to mandrel 30 at threads 36, which will convert tool 25 to a bridge plug. Threaded plug 82 has a reduced diameter section 84 that includes a seal 86 thereabout. Plug 82 may be threaded into mandrel 30 at the upper end thereof so that reduced portion 84 and seal 86 will extend into mandrel 30 and will sealingly engage passageway 46. The installation of plug 82 converts tool 25 from a frac plug to a bridge plug, which may be referred to as bridge plug 25A. FIG. 5 shows bridge plug 25A, which essentially comprises tool, or frac plug 25 with plug 82 threaded therein. Bridge plug 25A may be lowered into well 10 and set by means known in the art. When bridge plug 25A is in the set position with packer elements 62 sealingly engaging casing 20, bridge plug 25A will prevent flow both upwardly and downwardly therethrough so that no fluid therebelow can pass therethrough. Thus, tool 25 without plug 82 comprises a frac plug which is easily convertible to a bridge plug simply by threading plug 82 into mandrel 30. Frac plug 25 is easily assembled by placing ball 80 in bottom end section 70 and connecting mandrel 30 to lower end section 70 by threading them together. Because the components, namely, mandrel 30, lower end section 70, and plug 82 are threaded, the components are easily and quickly assembled, and may be connected and disconnected without damaging the tool 25 or any components thereof.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A frac plug for use in a well comprising:

a mandrel defining a flow passage therethrough, the mandrel having a threaded upper end for receiving a threaded plug;

a packer element disposed about the mandrel movable from a first position to a second position wherein the packer element sealingly engages the well in the second position;

a lower end section with a flow passage defined therethrough connected to the mandrel, the lower end section defining a seat therein; and a ball retained in the lower end section between the seat and a lower end of the mandrel, wherein the ball will engage the seat and prevent downward flow through the lower end section when the packer element is in the second position.

2. The frac plug of claim 1 wherein the lower end section is threadedly connected to the mandrel.

3. The frac plug of claim 1, wherein the lower end section comprises a mule shoe.

4. A bridge plug comprising the frac plug of claim 1 wherein a threaded plug is threadedly connected in the threaded upper end thereof.

5. The bridge plug of claim 4 wherein the lower end section comprises a mule shoe, and the mandrel, mule shoe and threaded plug are comprised of a non-metallic material.

6. The bridge plug of claim 5, wherein the non-metallic material is a phenolic material.

7. A frac plug for use in a well comprising:

a mandrel having upper and lower ends; and an end section connected to one of the upper or lower ends, the end section having a closing ball movably housed therein, the other of the upper and lower ends adapted to connect to a plug to prevent flow through the mandrel, wherein the closing ball is retained in the end section by the end of the mandrel to which the end section is attached, and the other end of the mandrel is threaded for connection to the plug.

8. The frac plug of claim 7, wherein:

the end section comprises a lower end section threadedly connected to the mandrel at the lower end thereof; and the closing ball is housed in the lower end section and retained therein by the lower end of the mandrel.

9. The frac plug of claim 8 wherein the lower end section comprises a mule shoe.

10. The frac plug of claim 8 wherein the closing ball is movable between the lower end of the mandrel and a seat defined on the lower end section.

11. The frac plug of claim 8 further comprising a packer element retained about the mandrel for sealingly engaging the well.

12. The frac plug of claim 11, wherein the closing ball prevents flow downwardly through the frac plug when the packer element sealingly engages the well, and permits upward flow therethrough when the packer sealingly engages the well.

13. A bridge plug comprising the frac plug of claim 8, wherein the plug is threadedly connected in the mandrel at the upper end thereof.

14. The bridge plug of claim 13, wherein the mandrel, plug and lower end section are comprised of a non-metallic material.

15. The frac plug of claim 8, wherein the mandrel and lower end section are comprised of a non-metallic material.

16. The frac plug of claim 15 wherein the non-metallic material is a phenolic material.

17. A method of assembling a frac plug comprising:

placing a closing ball in a lower end section of the frac plug, the lower end section defining a flow passage therethrough; and connecting a mandrel of the frac plug to the end section to entrap the closing ball in the end section, wherein the mandrel has a packer element retained thereon for sealingly engaging a well, and the mandrel has a threaded upper end for receiving a threaded plug.

18. The method of claim 17, the connecting step comprising threading the mandrel into the lower end section.

19. The method of claim 17 comprising converting the frac plug into a bridge plug.

20. The method of claim 19, the converting step comprising threading the threaded plug into an upper end of the mandrel.

21. The method of claim 17, the mandrel and the lower end section comprising a phenolic material.

22. A downhole tool for use in a well comprising:

a mandrel having upper and lower ends;

a sealing element disposed about the mandrel and movable from a first to a second position, wherein the sealing element engages the well in the second position;

an end section connected to one of the upper and lower ends;

a closing ball housed in the end section; and a plug connectable to the end opposite the end to which the end section is connected, wherein the tool comprises a frac plug when the plug is not connected, and a bridge plug when the plug is connected, the mandrel having a threaded end for receiving the plug.

23. The downhole tool of claim 22, the mandrel and plug being comprised of a phenolic material.

24. The downhole tool of claim 22, the upper end of the mandrel having threads, wherein the plug is threadedly connectable to the upper end, and wherein the end section comprises a lower end section threadedly connected to the lower end of the mandrel.

25. The downhole tool of claim 24, the mandrel, plug and lower end section comprising a phenolic material.

26. A downhole tool for use in a well comprising:

a mandrel having upper and lower ends;

a sealing element disposed about the mandrel and movable from a first to a second position, wherein the sealing element engages the well in the second position;

an end section connected to one of the upper and lower ends;

a closing ball housed in the end section;

a plug connectable to the end opposite the end to which the end section is connected, the plug is threadedly connectable to the mandrel and the mandrel and plug are comprised of a phenolic material; and wherein the tool comprises a frac plug when the plug is not connected, and a bridge plug when the plug is connected.

* * * * *